United States Patent [19]

Baugh

[11] Patent Number: 4,917,534

[45] Date of Patent: Apr. 17, 1990

[54] EPOXY FLOOR FINISHING MACHINE

[76] Inventor: Teddie G. Baugh, P.O. Box 616, Carthage, Mo. 64836

[21] Appl. No.: 221,058

[22] Filed: Jul. 19, 1988

[51] Int. Cl.[4] ..... E01C 19/16

[52] U.S. Cl. ..... 404/97; 404/108; 404/111; 118/108

[58] Field of Search ..... 404/96, 97, 101, 108, 404/110, 111, 118, 85; 118/108; 425/458; 15/235.4, 235.8

[56] References Cited

U.S. PATENT DOCUMENTS

| | | | |
|---|---|---|---|
| 791,726 | 6/1905 | Schutte | 404/118 X |
| 3,174,413 | 3/1965 | Wittmack, Jr. | 404/118 |
| 3,273,474 | 9/1966 | Hardin et al. | 404/101 |
| 3,319,600 | 5/1967 | Regan | 118/108 |
| 4,752,154 | 6/1988 | Valentine | 404/101 X |

FOREIGN PATENT DOCUMENTS

| | | | |
|---|---|---|---|
| 42402 | 11/1965 | Fed. Rep. of Germany | 404/118 |

*Primary Examiner*—Jerome W. Massie, IV
*Assistant Examiner*—Matthew Smith
*Attorney, Agent, or Firm*—Warren L. Franz

[57] ABSTRACT

A method and apparatus for smoothing epoxy flooring material utilizes a weighted chassis to the bottom of which are mounted two planar blades in angular adjustable manner. A handle mounted pivotally to the top of the chassis may be brought forward to tilt the chassis, bringing normally elevated wheels into ground contact for transporting the apparatus in blade floor noncontacting positions.

1 Claim, 1 Drawing Sheet

FIG. 4
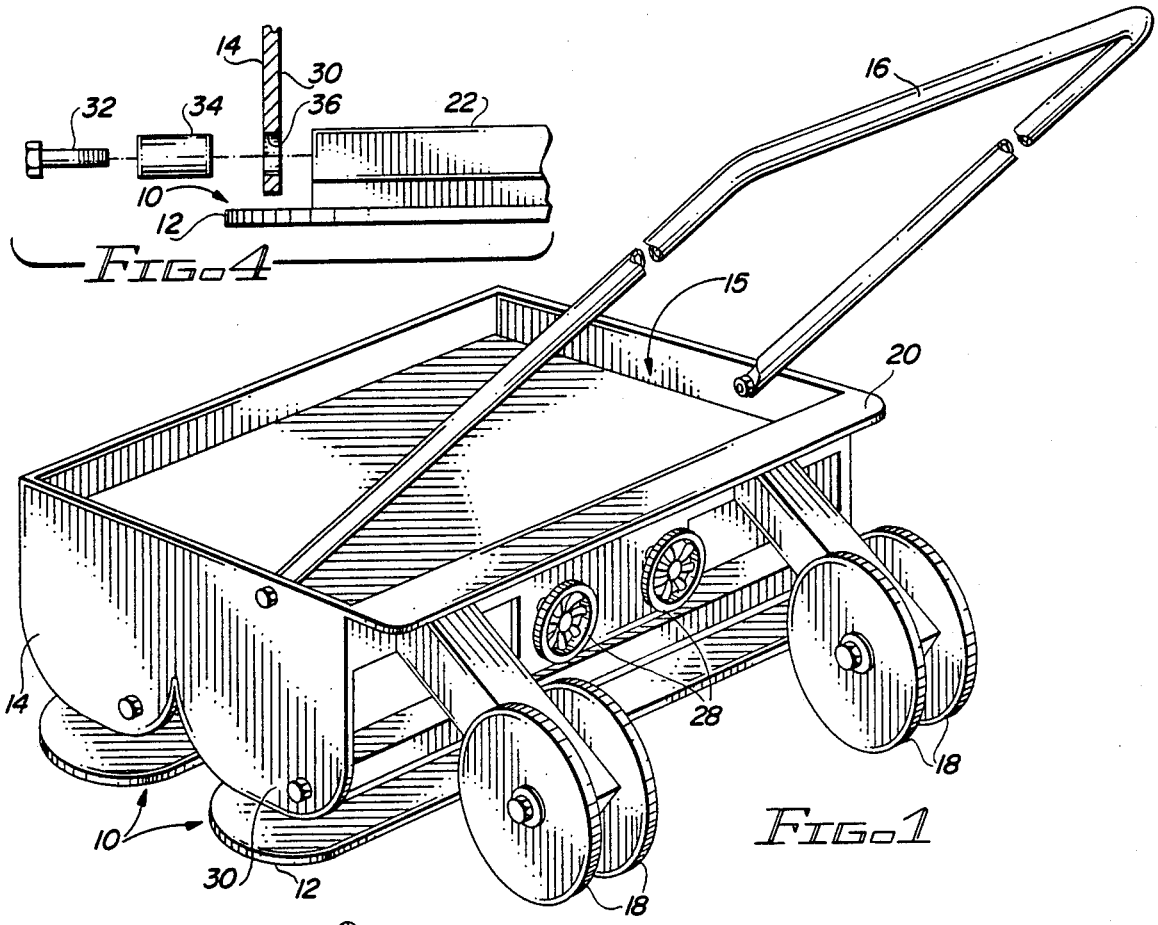
FIG. 1
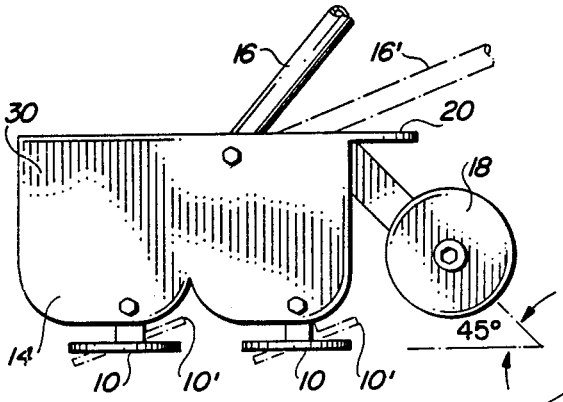
FIG. 2
FIG. 3
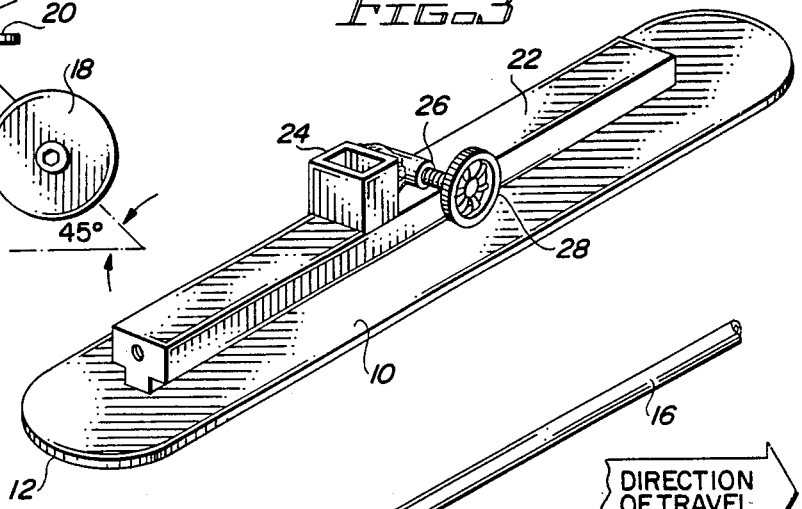
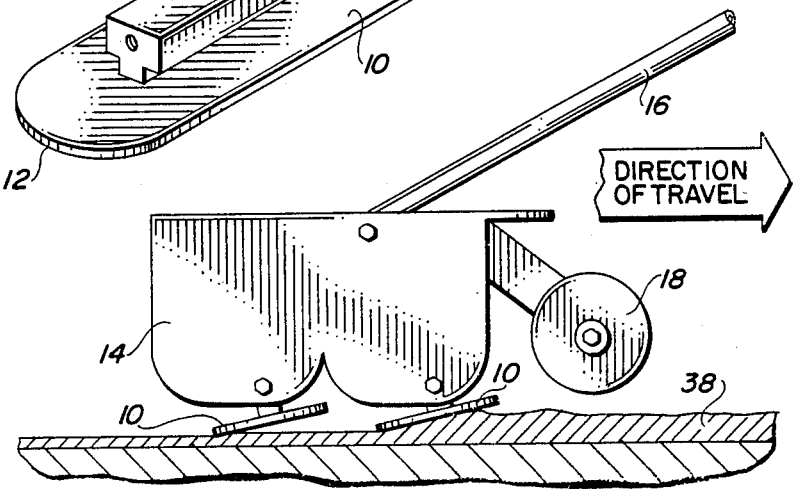
FIG. 5

EPOXY FLOOR FINISHING MACHINE

This invention relates to floor finishing methods and apparatus; and, in particular, to new and improved method and apparatus for the smoothing of epoxy flooring material.

BACKGROUND OF THE INVENTION

Epoxy polymer floor laid down over a concrete base is applied first with a screed box or other implement to desired thickness. This gives it a gravel-like, gritty texture that must be smoothed out. Conventional finishing for smoothing is to use a hand trowel. This requires time and considerable skill to not leave trowel marks. Power trowels, such as used in concrete work for floating, may be utilized but leave swirls where the trowel rotates. Moreover, the troweling of an epoxy floor differs considerably from concrete troweling because of the greater thickness and stickiness of the epoxy material.

SUMMARY OF THE INVENTION

The invention provides a method and apparatus for smoothing epoxy flooring material in an economic manner and with a neat appearance, without the necessity for the skill and training required with conventional epoxy floor laying methods and apparatus.

In one aspect of the invention, epoxy flooring material is brought to a smooth finished appearance by use of novel floor finishing apparatus having two laterally-spaced, elongated rigid blades with rounded ends, pivotally mounted for angular adjustment below a chassis including a weight receiving tray and a pivotable handle. Wheels are mounted in elevated position on the side of the chassis, and means is provided to bring the wheels into contact with the floor by tilting the handle, thereby placing the blades in floor noncontacting positions during transportation of the machine between jobs.

A preferred embodiment of the machine, discussed below, has Fresno Trowel type blades which extend beyond opposite walls of the chassis, and the lower extents of end walls of the chassis are contoured to provide recesses to accommodate the angular extremes of the blades.

BRIEF DESCRIPTION OF THE DRAWINGS

FIG. 1 is a perspective view of an epoxy floor finishing machine in accordance with the principles of the invention;

FIG. 2 is a side elevation view of the machine of FIG. 1;

FIG. 3 is a detailed view of one of the blades of the machine of FIG. 1;

FIG. 4 is an exploded view of the pivotal attachment of the blade to the machine wall; and FIG. 5 is a schematic showing use of the machine of FIG. 1.

DETAILED DESCRIPTION OF PREFERRED EMBODIMENT

The invention (see FIGS. 1 and 2) provides dual 30" wide steel blades 10 with rounded ends 12 carried on a steel chassis 14, having a rectangular tray 15 into which three 68 pound weights (not shown) are placed. Blades 10 are pivotally mounted in laterally spaced parallel positions and means is provided to vary the angle of the blades. A handle 16 extends upwardly from the chassis 14 for dragging the finisher across the epoxy material to be finished. Wheels 18 mounted at the front of the chassis in normally floor noncontacting positions may be used to bring the finisher to its start position by lowering the handle into its forwardmost pivoted position in which it contacts the front lip 20 of the finisher (dot-dash position in FIG. 2). Further depression of the handle will lower the wheels 18 to the ground by tilting the finisher, and lift the blades 12 off the ground for nonoperational transport of the finisher. The blades 10 are rounded at the ends 12, similar to the edges of conventional California style Fresno concrete trowels available from Goldblatt Tool Co., Kansas City, KS, to avoid edge lines.

The blades 10 are elongated, flat planar steel members which have a 1" keystock (rectangular) bar 22 running centrally and longitudinally (FIG. 3). A central upright member 24 completes a T-bar on top of the blade 10. Rotation of a threaded member 26, attached to the member 24 by a knob 28, draws or pushes the upright 24 away from the knob 28, pivoting the keystock 22 about its axis and varying the blade angle (see FIG. 3). The ends of the keystock 22 are rotationally attached, (as shown in FIG. 4) to chassis walls 30 (FIG. 4) by bolts 32 passing through bushings 34 received in apertures 36 of the walls 30. The lower portions of the chassis walls 30, extending below the bottom of the weight tray 15, are shaped to accommodate the edges of the blades 12 at extreme angled positions (see dot-dash positions 10" of blades in FIG. 2).

In operation, the weighted chassis 14 is dragged by handle 16 across the previously deposited epoxy material 38 (FIG. 5), with the blades 10, suitably angled by adjustment of the knob 28 to provide the desired smoothing.

Those skilled in the art to which the invention relates will appreciate that the foregoing detailed description is merely exemplary and not exclusive; and it is intended that the invention as defined by the appended claims encompass all such substitutions and modifications as may be made to the described embodiments without departing from the spirit and scope of the invention.

What is claimed is:

1. An epoxy floor finishing machine, comprising:

a chassis accommodated to receive weights thereon;

a plurality of laterally spaced, elongated rigid blades mounted to the underside of the chassis and having flat undersurfaces for smoothing epoxy flooring material and rounded ends for avoidance of edge lines in the flooring;

means for pivoting the blades about their axes and for establishing fixed positions of the blades relative to the chassis for selecting the angling of the blades for smoothing the flooring material;

wheels mounted on the chassis in normally raised position above the blades when the blades are in a flooring contacting position;

handle means freely pivotable relative to the chassis for dragging the blades of the weighted chassis across the flooring during smoothing; and stop means located on the chassis, establishing a selectively encounterable limit to the pivoting of the handle means about the chassis, for lowering the wheels for transportation of the chassis in a blade floor noncontacting position.

* * * * *